US009812821B2

(12) United States Patent
Hagemeier et al.

(10) Patent No.: US 9,812,821 B2
(45) Date of Patent: Nov. 7, 2017

(54) CONNECTION MODULE WITH LIGHT DISPLAY

(71) Applicant: PHOENIX CONTACT GMBH & CO KG, Blomberg (DE)

(72) Inventors: Willi Hagemeier, Schieder-Schwalenberg (DE); Falk Langer, Zwonitz (DE)

(73) Assignee: PHOENIX CONTACT GMBH & CO KG, Blomberg (DE)

( * ) Notice: Subject to any disclaimer, the term of this patent is extended or adjusted under 35 U.S.C. 154(b) by 0 days.

(21) Appl. No.: 14/764,660

(22) PCT Filed: Jan. 14, 2014

(86) PCT No.: PCT/EP2014/050578

§ 371 (c)(1),
(2) Date: Jul. 30, 2015

(87) PCT Pub. No.: WO2014/117996

PCT Pub. Date: Aug. 7, 2014

(65) Prior Publication Data

US 2015/0372432 A1 Dec. 24, 2015

(30) Foreign Application Priority Data

Jan. 31, 2013 (DE) ..... 10 2013 100 987

(51) Int. Cl.
*G09F 3/06* (2006.01)
*H01R 13/717* (2006.01)
(Continued)

(52) U.S. Cl.
CPC ..... *H01R 13/7175* (2013.01); *H01R 13/641* (2013.01); *H01R 13/717* (2013.01); *H01R 27/02* (2013.01); *H01H 19/025* (2013.01)

(58) Field of Classification Search
CPC ..... H01R 13/641; H01R 13/6691; H01R 13/717; H01R 13/7175; H01R 27/02;
(Continued)

(56) References Cited

U.S. PATENT DOCUMENTS 3,262,224 A 7/1966 Hardesty
3,582,927 A * 6/1971 Primavera ..... H02B 15/02 340/815.49
(Continued)

FOREIGN PATENT DOCUMENTS

DE 41 02 448 A1 7/1992
DE 41 22 118 A1 1/1993
(Continued)

OTHER PUBLICATIONS

International Search Report (PCT/ISA/210) dated May 21, 2014, by the European Patent Office as the International Searching Authority for International Application No. PCT/EP2014/050578.
(Continued)

*Primary Examiner* — Shin Kim
(74) *Attorney, Agent, or Firm* — Buchanan Ingersoll & Rooney PC

(57) ABSTRACT

The disclosure relates to a connection module, including a plurality of connections for functional elements and a plurality of operating indicators. At least one of the operating indicators has a display element, and the display element has a base, which is disposed as a light guide and which has a light in-coupling surface and a light out-coupling surface.

17 Claims, 8 Drawing Sheets

Figure 1:
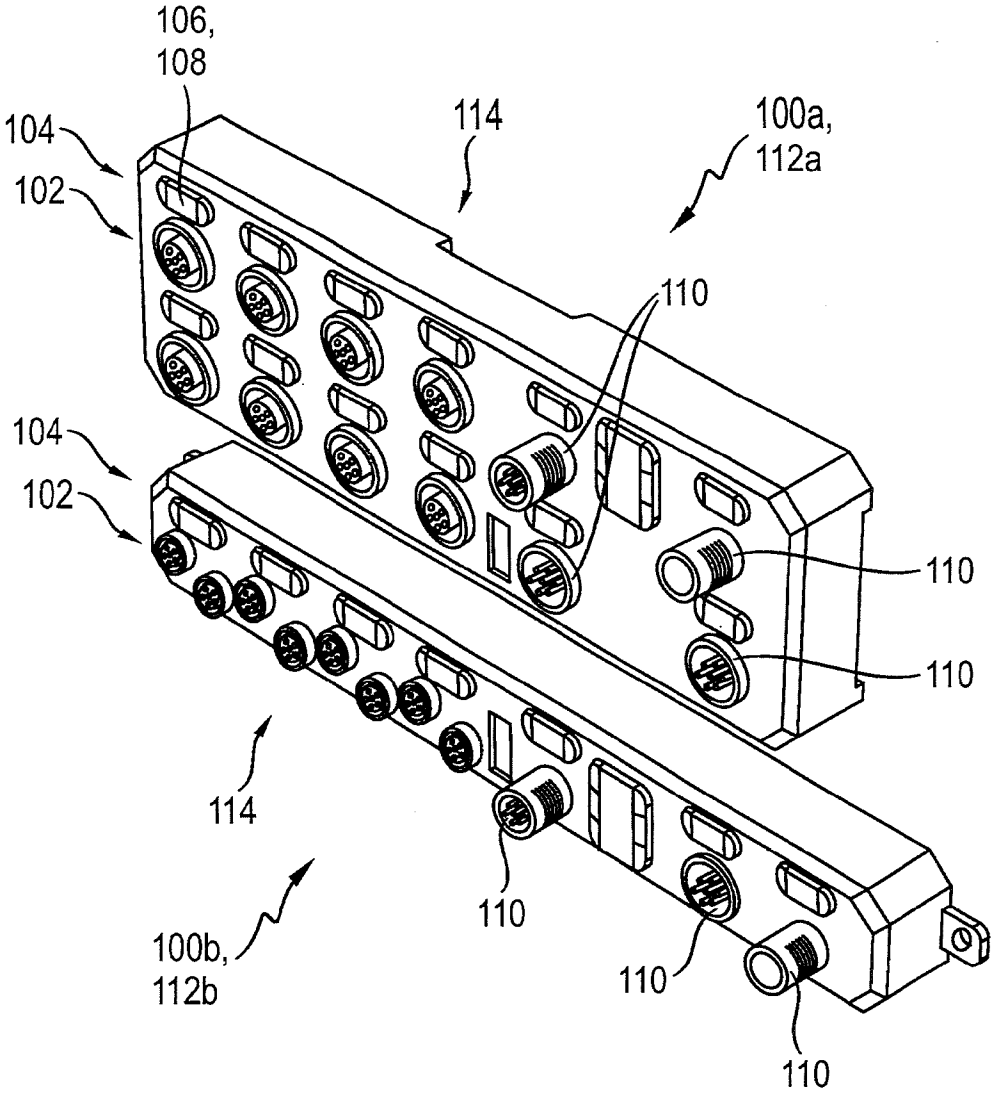

(51) Int. Cl.
*H01R 13/641* (2006.01)
*H01R 27/02* (2006.01)
*H01H 19/02* (2006.01)

(58) Field of Classification Search
CPC ..... G09F 13/04; G09F 13/22; G09F 15/00; G09F 3/204; G09F 7/18; G09F 7/00; G09F 3/208; G09F 15/0012; G09F 2013/222
See application file for complete search history.

(56) References Cited

U.S. PATENT DOCUMENTS 5,212,899 A * 5/1993 Fandreyer ..... G09F 3/20 174/66
5,263,271 A 11/1993 Cox et al.
5,613,874 A * 3/1997 Orlando ..... H01R 13/465 40/607.13
5,818,343 A * 10/1998 Sobel ..... G08B 5/00 340/815.43
6,026,605 A * 2/2000 Tippett ..... H01H 9/18 174/66
6,172,301 B1 * 1/2001 Goodsell ..... H02G 3/14 174/66
6,593,530 B2 * 7/2003 Hunt ..... H01H 9/18 174/66
6,718,674 B2 * 4/2004 Caveney ..... G09F 3/20 40/611.09
7,503,790 B2 3/2009 Bodmann et al.
7,690,141 B2 * 4/2010 Steinfort ..... A01K 11/004 119/655
8,115,099 B2 2/2012 Bodmann et al.
8,695,258 B2 * 4/2014 Kori ..... G09F 7/06 40/663
9,071,369 B2 6/2015 Schlittmeier et al.
2002/0136502 A1 9/2002 Bachl et al.
2005/0102043 A1 * 5/2005 Menas ..... G06F 1/26 700/22
2006/0225327 A1 * 10/2006 Peters ..... G09F 9/305 40/547
2008/0102708 A1 * 5/2008 Wu ..... H01R 13/665 439/652
2009/0008880 A1 1/2009 Bodmann et al.
2009/0051558 A1 2/2009 Dorval
2009/0152821 A1 6/2009 Bodmann et al.
2009/0196028 A1 * 8/2009 Chao ..... G09F 13/04 362/183
2011/0102155 A1 * 5/2011 Choi ..... G06Q 30/06 340/10.6
2013/0163271 A1 6/2013 Schlittmeier et al.
2014/0233902 A1 * 8/2014 Ruiz ..... H04Q 1/136 385/135
2014/0317978 A1 * 10/2014 Kim ..... G09F 3/06 40/638
2014/0321810 A1 * 10/2014 Leigh ..... H01R 13/641 385/71
2015/0004832 A1 * 1/2015 Homan ..... H01R 13/717 439/490

FOREIGN PATENT DOCUMENTS

DE 197 09 529 A1 9/1998
DE 10 2004 056 247 A1 5/2006
DE 10 2008 036 373 A1 2/2010
DE 10 2010 040 534 A1 3/2012
EP 2 012 573 A2 1/2009
EP 2 106 001 A1 9/2009
WO WO 01/40707 A1 6/2001

OTHER PUBLICATIONS

Office Action dated Aug. 22, 2013, by the German Patent Office in corresponding German Patent Application No. 10 2013 100 987.5. (5 pages).
Office Action (Second Notification of the Office Action) dated Dec. 16, 2016 by the State Intellectual Property Office of the People's Republic of China in corresponding Chinese Patent Application No. 201480006583.7, and English language translation of Office Action (13 pages).

* cited by examiner

CONNECTION MODULE WITH LIGHT DISPLAY

The invention relates to a connection module with a plurality of connections for functional elements and with a plurality of operating indicators.

Connection modules such as this are used in order to achieve machine-oriented signal acquisition in an automation installation. Connection modules such as this enable installation and service costs to be reduced since control cabinets and conductor materials can be saved, and commercially available plug-in connectors enable simple and reliable connection. The operating indicators of connection modules such as this enable it to be easily checked whether signals are present at the respective connections of the connection module. However, separate operating indicators with light sources are necessary for this purpose, which operating indicators are arranged in the vicinity of the connections in order to enable simple and intuitive assignment of an operating indicator to a connection. This leads to a complicated design of such connection modules.

The object of the present invention is therefore to provide a connection module with a simplified design.

This object is achieved by the subject matter having the features according to the independent claims. Advantageous embodiments are the subject matter of the dependent claims, the description and the drawing.

The present invention is based on the knowledge that the design of such a connection module is simplified by the use of a light guide.

According to a first aspect, the problem is solved in that at least one of the operating indicators has a display element, and in that the display element has a base body which is configured as a light guide and which has a light in-coupling surface and a light out-coupling surface. This results in the technical advantage that light signals from a light source can be forwarded, wherein the light source is arranged so as to be remote from the display element. As a result, the design of the connection module is simplified.

In an advantageous embodiment, the display element has a labeling field element. This results in the technical advantage that information about the functional element connected to the connection is provided by means of the labeling field element, for example by a particular color configuration of the labeling field element, for example green for sensor and blue for actuator. Thus, simple and rapid assignment is possible when checking the functionality of the automation installation.

In another advantageous embodiment, the labeling field element has a labeling field light in-coupling surface and the labeling field light in-coupling surface is in light-conductive contact with the light out-coupling surface. This results in the technical advantage that light signals from the light out-coupling surface can be coupled into the labeling field element and then coupled out, with the result that the labeling field element itself is illuminated and the information of the labeling field element is available without the aid of additional illumination means.

In another advantageous embodiment, the labeling field element has a labeling. This results in the technical advantage that further information regarding the functional elements connected to the connection module is available. In this case, the labeling can be configured to be clear, white or colored in order to ensure particularly simple recognizability, for example by contrast.

In another advantageous embodiment, the labeling field element has a guide section which is in engagement with a guide of the base body. This results in the technical advantage that the labeling field element is securely mounted on the base body but can be separated from the base body by a displacement of the guide section in the guide and optionally exchanged or provided with another labeling if another function module is connected to a connection. Thus, the manageability of the connection module is improved.

In another advantageous embodiment, the guide section and the guide define a first mounting direction for mounting the labeling field element on the base body, wherein the first mounting direction differs from a second mounting direction for mounting the display element on the connection module. This results in the technical advantage that the connection module has a particularly simple design.

In another advantageous embodiment, the first mounting direction and the second mounting direction are arranged at right angles to one another. As a result of this, the design of the connection module is once again simplified.

In another advantageous embodiment, the base body has a base section with the light out-coupling surface and two arm sections which adjoin the base body and each have a light in-coupling surface. This results in the technical advantage that the base body forwards various light signals which are coupled into the respective light in-coupling surfaces. Thus, a variety of information originating from various light sources can be displayed by the display element.

In another advantageous embodiment, the base section and the two arm sections are configured in one piece and/or materially integrally. This results in the technical advantage that light signals coupled in at the light in-coupling surfaces do not experience interruption when passing through the base body at boundaries in the form of connection surfaces, and thus optimum forwarding of light signals is ensured.

In another advantageous embodiment, the base body is made from plastic. This results in the technical advantage that the base body can be produced mechanically and hence particularly cost-effectively using known technologies from easily available materials.

In another advantageous embodiment, the base body has a latching element for fastening to the connection module. This results in the technical advantage that the base body is securely fastened to the connection module and is not undesirably released and displaced by vibrations occurring in the environment of an automation installation. Thus, operational reliability is increased.

In another advantageous embodiment, the connection module has an opening in which the display element is at least partially received. This results in the technical advantage that the base body can conduct light signals from the interior of the connection module to the operating indicator. Thus, the connection module has a particularly simple design.

In another advantageous embodiment, the connection module has a light source emitting light into the light in-coupling surface. This results in the technical advantage that light signals can be generated by the light source and can be conducted by the base body to the display element and can display various signals, for instance digital signal states, displays of input/output signal states (IO signal states), displays of diagnostic states of connected devices and/or displays of network states.

According to a second aspect, the problem is solved by a display element for such a connection module. This results in the technical advantage that light signals from a light source, which is arranged so as to be remote from the display element, can be forwarded. As a result, the design of the connection module is simplified.

According to a third aspect, the problem is solved by a labeling field element for such a display element. This results in the technical advantage that light signals from a light source, which is arranged so as to be remote from the display element, can be forwarded. As a result, the design of the connection module is simplified.

Figure 2:
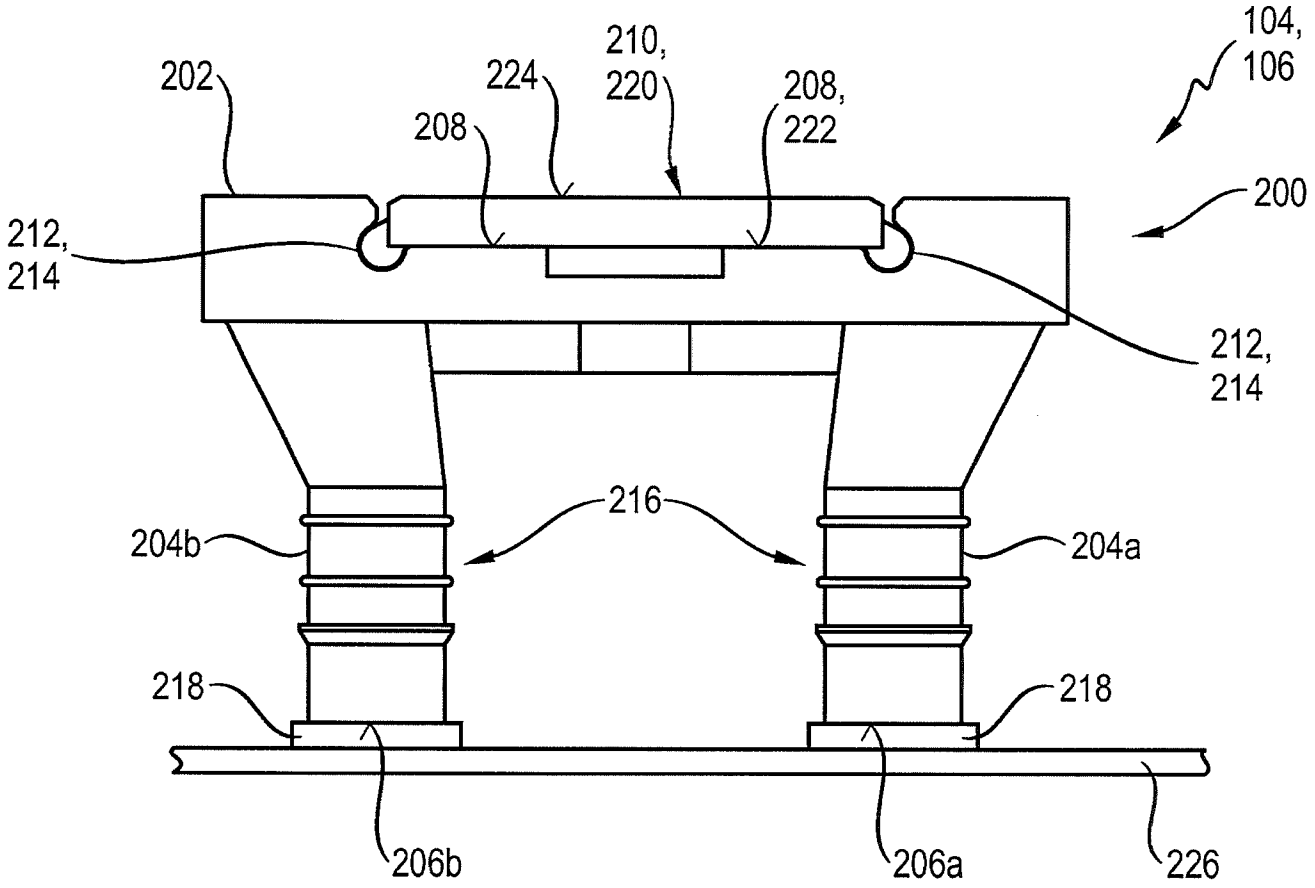
Figure 3:
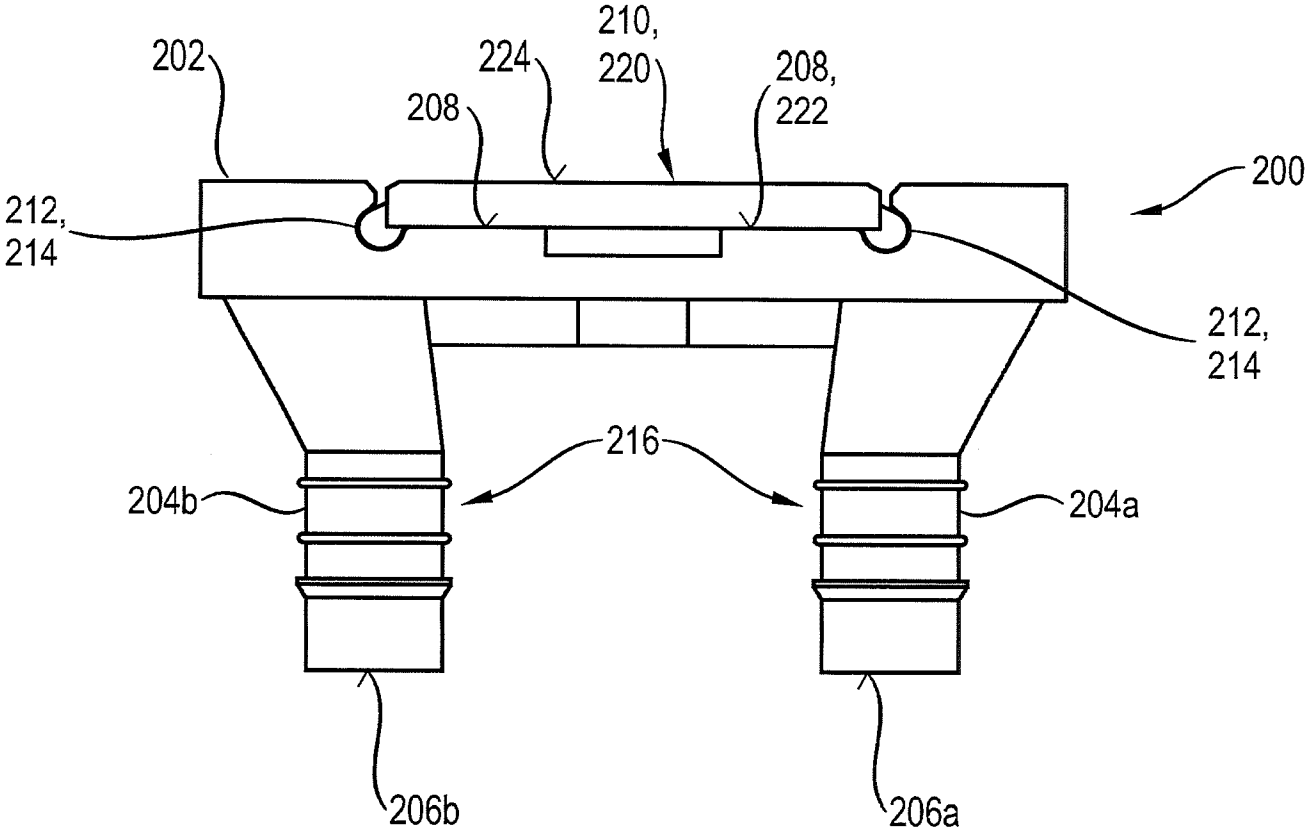
Figure 4:
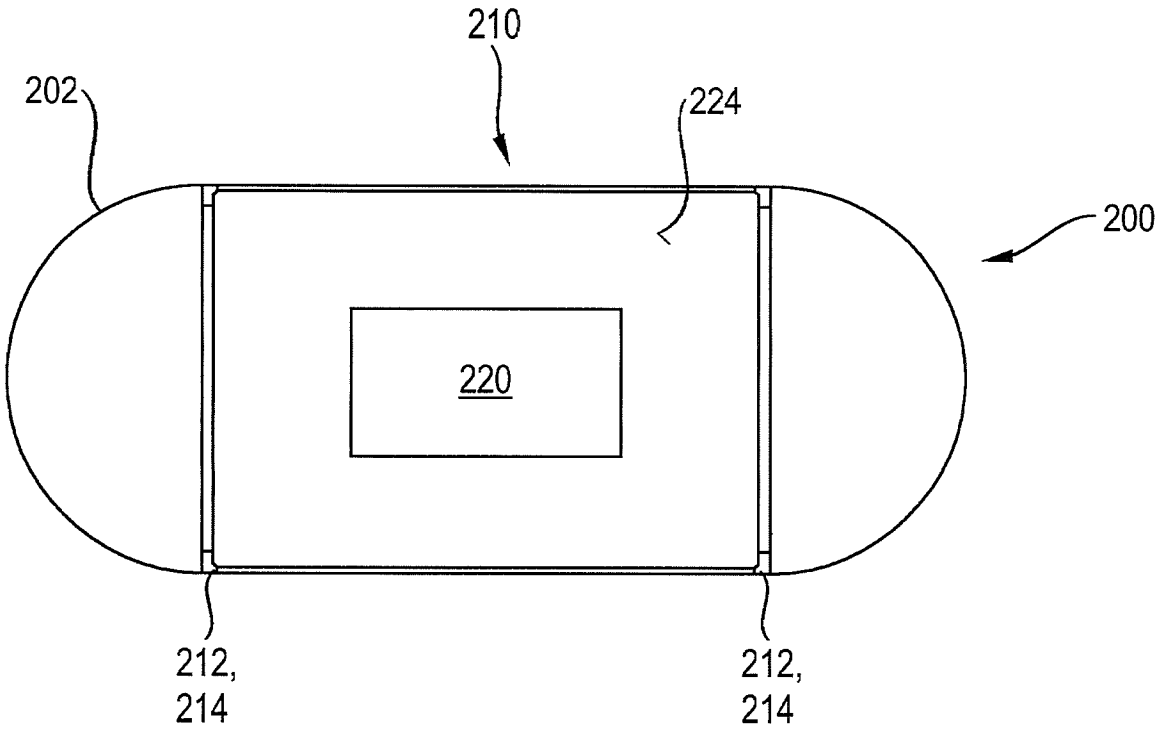
Figure 5:
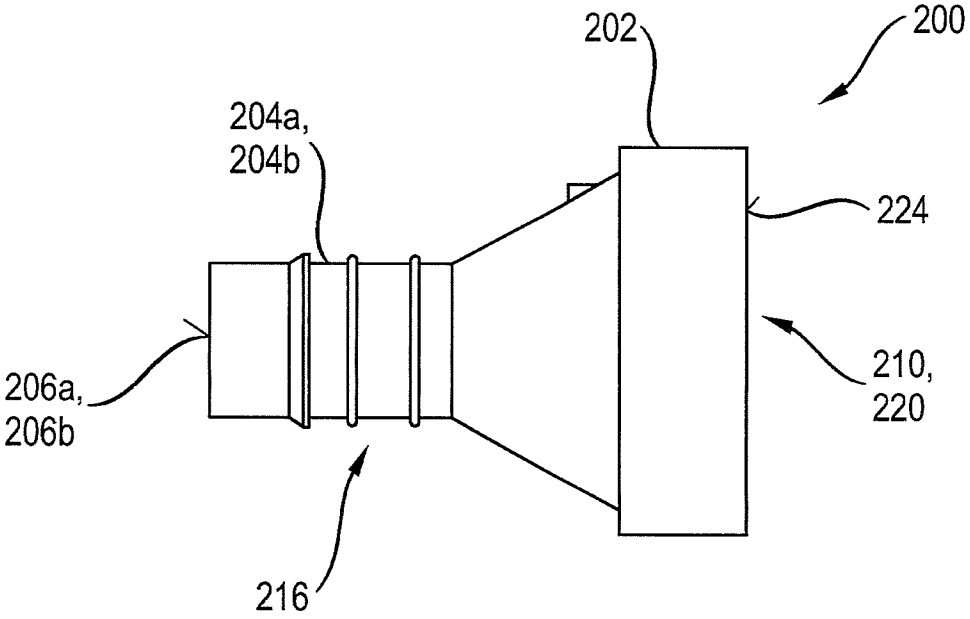
Figure 6:
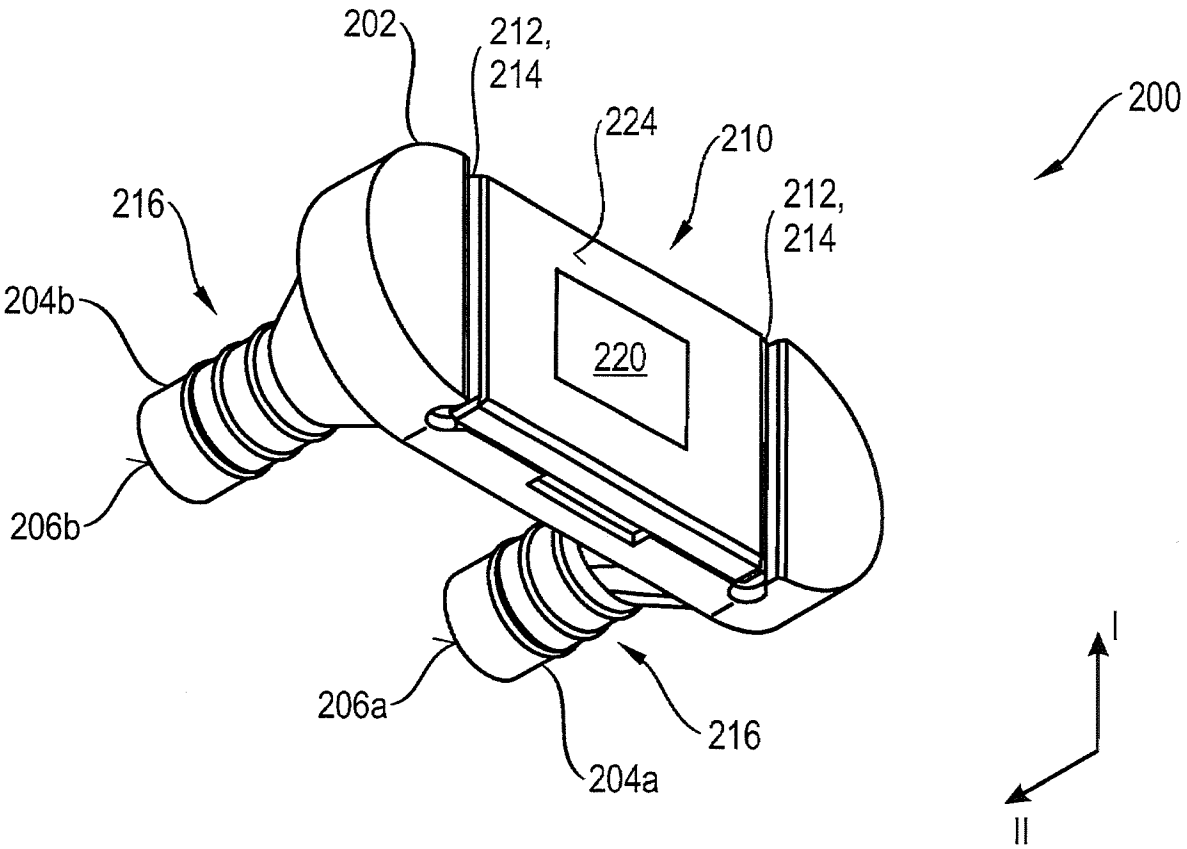
Figure 7:
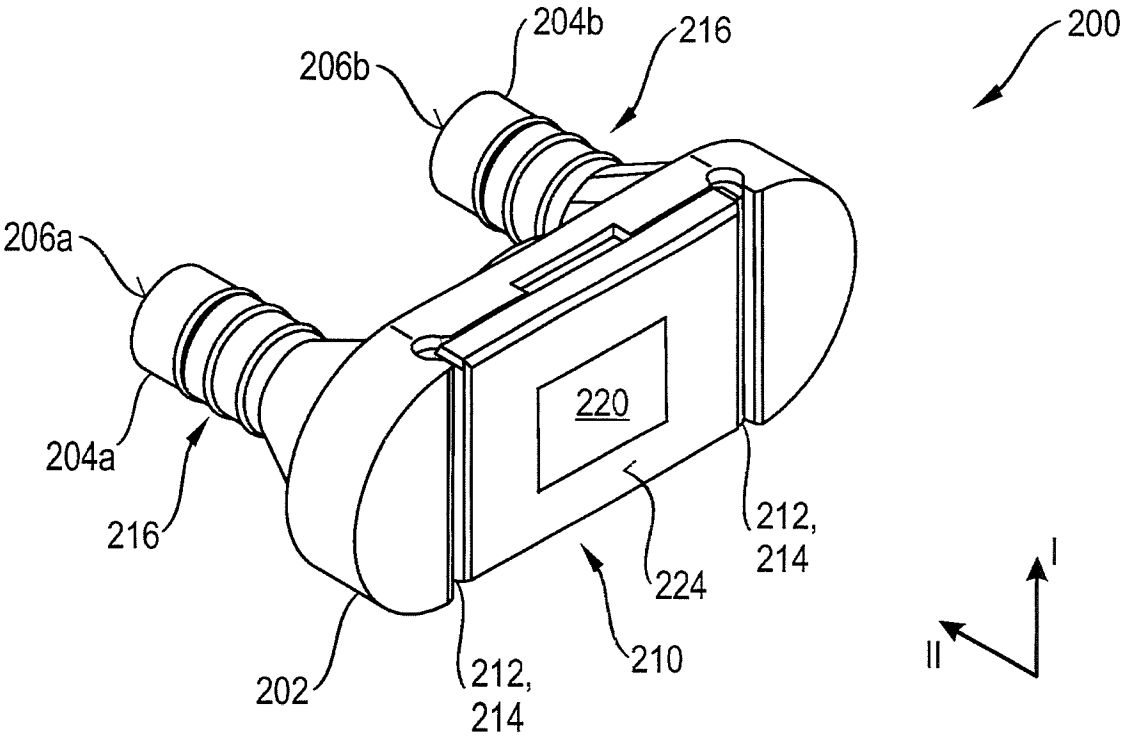
Figure 8:
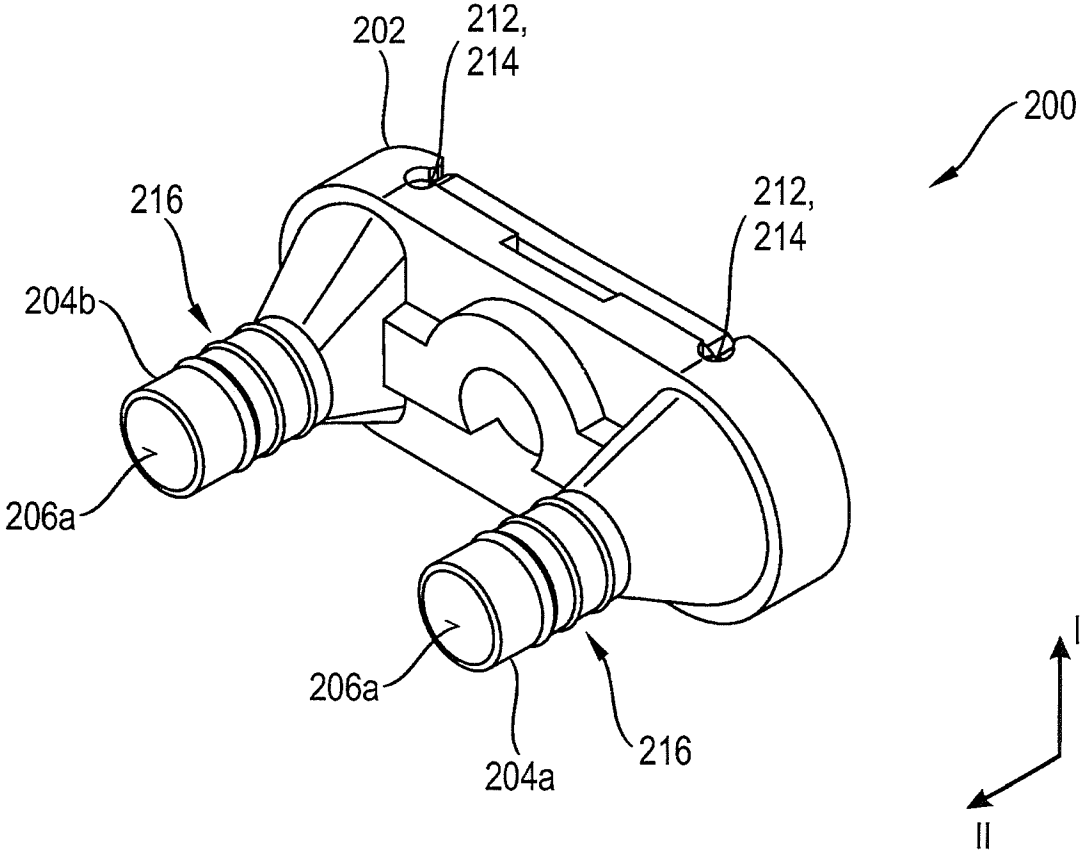

Further exemplary embodiments are explained with reference to the appended drawings, in which FIG. 1 shows a perspective view of two exemplary embodiments of connection modules, FIG. 2 shows a sectional illustration through a section of a connection module in FIG. 1, FIG. 3 shows a side view of a base body, FIG. 4 shows a plan view of the base body, FIG. 5 shows a side view of the base body, FIG. 6 shows a perspective illustration of the base body, FIG. 7 shows another perspective illustration of the base body, and FIG. 8 shows another perspective illustration of the base body.

FIG. 1 shows a first connection module 100*a* and a second connection module 100*b*. These are input/output signal devices and/or function devices in the field of automation engineering for insertion into an automation installation.

In the present exemplary embodiment, the first connection module 100*a* and the second connection module 100*b* are configured as sensor/actuator boxes for machine-oriented signal acquisition in an automation installation.

In the present exemplary embodiment, the first connection module 100*a* has eight connections 102, which are configured in the present exemplary embodiment as M12 connections and enable in the present exemplary embodiment the connection of in each case one sensor or actuator as functional element to each of the connections 102. Thus, the connections 102 in the present exemplary embodiment are configured as sensor/actuator connections. Furthermore, the connection module 100*a* in the present exemplary embodiment has four further connections 110 of which two are configured as M12 connections in the present exemplary embodiment. Using the further connections 110, for example sensor signals can be forwarded from the connections 102 to further components of the automation installation. The further connections 110 can be, for example, a network bus connection or field bus connection, which may also be configured as socket/socket connectors, for example in the case of Ethernet-based devices. In the present exemplary embodiment, one of the further connections 110 is configured as a plug/socket field bus interface. It is possible for a connection for a voltage supply, in the present exemplary embodiment for supplying and conducting electricity, to be arranged in a second row.

In the present exemplary embodiment, the connection module 100*b* has eight connections 102, which are configured as M8 connections in the present exemplary embodiment and enable in the present exemplary embodiment the connection of in each case one sensor or actuator as functional element to each of the connections 102. Thus, the connections 102 are configured as sensor/actuator connections. Furthermore, the connection module 100*b* has three further connections 110 of which one connection is configured as M12 connection in the present exemplary embodiment. Here, too, the further connections 110 enable sensor signals to be forwarded from the connections 102 to further components of the automation installation. The further connections 110 can be, for example, a network bus connection or field bus connection, which may also be configured as sockets, for example in the case of Ethernet-based devices. In the present exemplary embodiment, one of the further connections 110 is configured as a plug of an incoming field bus interface. It is possible, in the present exemplary embodiment, for a connection for a continuing field bus or for an Ethernet interface to be arranged in a second row and for a connection for a voltage supply to be arranged in a third row.

In the present exemplary embodiment, an operating indicator 104 is assigned to each of the connections 102 and each of the further connections 110. The operating indicators 104 are used to optically signal digital signal states, to display input/output signal states, to display diagnostic states of devices of the automation installation and to display network states. Each operating device 104 has a display element 106 which is received in each case one opening 108 of a housing 112*a*, 112*b* of the connection modules 100*a*, 100*b*. In the present exemplary embodiment, the housings 112*a*, 122*b* are impervious to dust and splashproof in order to ensure reliable operation of the connection modules 100*a*, 100*b* in an automation installation. In the present exemplary embodiment, the housings are made from plastic, for example by means of injection molding.

Furthermore, in the present exemplary embodiment, the housings 112*a*, 112*b* have stop means 114 the function of which is explained below. In the present exemplary embodiment, the stop means 114 are formed on the housings 112*a*, 112*b*. Thus, the housings 112*a*, 112*b* and the stop means 114 are configured in the present exemplary embodiment in one piece and materially integrally.

FIG. 2 shows the schematic design of the operating indicator 104 with the display element 106.

The display element 106 has a base body 200 in the present exemplary embodiment. The base body 200 comprises in the present exemplary embodiment a base section 202, a first arm section 204*a* and a second arm section 204*b*. In the present exemplary embodiment, the base body 200, comprising the base section 202 and the two arm sections 204, 204*b*, is made in one piece and materially integrally from an optically transparent plastic. However, the base body 200 may be optically colored, either completely or only in sections, in order to provide colored light.

The first arm section 204*a* has a first light in-coupling surface 206*a*, and the second arm section 204*b* has a second light in-coupling surface 206*b*. The first light in-coupling surface 206*a* is in contact with a light source 218 which is arranged on a circuit board 226 arranged in the interior of the connection module 100*a*, 100*b*. Furthermore, the second light in-coupling surface 206*b* is in contact with another light source 218 which is likewise arranged on the circuit board 226. In the present exemplary embodiment, the light source 218 is configured as an LED. Thus, light signals from the two light sources 218 can be coupled into the base body 200 through the two light in-coupling surfaces 206*a*, 206*b*.

The base section 202 of the base body 200 has a light out-coupling surface 208, wherein the first arm section 204*a* and the second arm section 204*b* join in the base section 202, with the result that light signals are guided from the first light in-coupling surface 206*a* at the first arm section 204*a* and/or from the second light in-coupling surface 206*b* at the second arm section to the light out-coupling surface 208.

The light out-coupling surface 208 of the base section 202 of the base body 200 is in contact with a labeling-field light in-coupling surface 222 of a labeling field element 210. Thus, light signals can be coupled into the labeling field element 210 from the light out-coupling surface 208 through the labeling-field light in-coupling surface 222, which labeling field element in turn has a labeling-field light out-coupling surface 224 for outputting the light signals.

The labeling field element 210 in the present exemplary embodiment is made from plastic, for example clear plastic. However, it may also be made from colored plastic. The labeling field 210 in the present exemplary embodiment has a guide section 212 which is in engagement with a guide 214 of the base body 200. In the present exemplary embodiment, the guide 214 is arranged in the base section 202. Furthermore, in the present exemplary embodiment, the guide 214 is configured as slot and the guide section 212 is configured as sliding block. The labeling field element 210 is fastened securely to the base body 200 by the guide section 212 engaging in the guide 214. In the present exemplary embodiment, the guide section 212 is formed in one piece on the labeling field element 210.

The labeling field element 210 in the present exemplary embodiment has a labeling 220 which displays information about, for example, the functional element which is connected to the connection 102. The labeling 220 can be applied to the labeling field element 210 by pressing-on or by surface-material removal, for example by milling or by laser treatment.

Finally, the base body 200 in the present exemplary embodiment has latching elements 216 which are arranged on the two arm sections 204, 205 and, in the present exemplary embodiment, are configured as rings surrounding the two arm sections 204*a*, 204*b* which dip into the opening 108 and latch there with correspondingly configured opening sections in order to securely fasten the display element 106 to the connection module 100*a*, 100*b*.

FIGS. 3 to 5 show the base body 200 with the base section 202, the two arm sections 204*a*, 204*b* and with the labeling field element 210 fastened to the base body 200 in a side view, a plan view and another side view.

FIGS. 6 to 8 show the base body 200, the base section 202 and the arm sections 204*a*, 204*b* with the attached labeling field element 210 in various perspective illustrations.

FIGS. 6 to 8 also show that the guide section 212 and the guide 214 define a first mounting direction I, with the result that the labeling field element 210 can be fastened to the base body 200 by displacing the labeling field element 210 in this direction. For this purpose, it is necessary first to bring the guide 214 into engagement with the guide section 212. By displacement in a second mounting direction II, the base body 200 is then fastened with the labeling field element 210 to the connection module 100*a*, 100*b* by the two arm sections 206*a*, 204*b* being displaced into the opening 108 in the direction of the second mounting direction II.

If the base body 200 with the labeling field element 210 has reached its end position in the opening 108, what is achieved by the corresponding configuration of the opening 108 is that a displacement of the labeling field element 210 in the guide 214 in the mounting direction I is blocked by stop means 114, for example an edge surrounding the opening 108. Thus, the labeling field element 210 cannot undesirably fall out or be released. Since in the present exemplary embodiment the first mounting direction I runs at right angles to the second mounting direction II, a particularly simple, intuitive mounting is given.

During operation, light signals from the light sources 218 on the circuit board 226 are coupled in through the two light in-coupling surfaces 206*a*, 206*b* to the arm sections 204*a*, 204*b* and forwarded to the base section 204 of the base body 200. Then, the light signals emerge out of the light out-coupling surfaces 208 and enter through the labeling-field light in-coupling surface 222 into the labeling field element 210, where they emerge again through the labeling-field light out-coupling surface 224 and illuminate a labeling 220.

The operating indicator 104 is used in the present exemplary embodiment to optically signal digital signal states, to display input/output signal states, to display diagnostic states of devices of the automation installation and to display network states.

By displacement in a second mounting direction II, the base body can be removed, and by displacement in the direction of the first mounting direction, the labeling field element 210 can be removed, for example in order to change or amend the labeling 220 or to replace the labeling field element 210 with another labeling field element 210 with another labeling 220. Thus, simple adaption to changes is possible.

LIST OF REFERENCE SIGNS

100*a* connection module
100*b* connection module
102 connection
104 operating indicator
106 display element
108 opening
110 further connection
112*a* housing
112*b* housing
114 stop means
200 base body
202 base section
204*a* arm section
204*b* arm section
206*a* light in-coupling surface
206*b* light in-coupling surface
208 light out-coupling surface
210 labeling field element
212 guide section
214 guide
216 latching element
218 light source
220 labeling
222 labeling-field light in-coupling surface
224 labeling-field light out-coupling surface
226 circuit board
I first mounting direction
II second mounting direction

The invention claimed is:

1. A connection module with a plurality of connections for functional elements and with a plurality of operating indicators, wherein at least one of the operating indicators has a display element, wherein the display element has a base body which is configured as a light guide and which has a light in-coupling surface and a light out-coupling surface, wherein the display element has a labeling field element, wherein the labeling field element has a labeling-field light in-coupling surface and wherein the labeling-field light in-coupling surface is in light-conductive contact with the light out-coupling surface of the base body, and wherein the labeling field element has an integral guide section configured for insertion into a guide of the base body in a specified first direction for fastening of the labeling field element in a second direction perpendicular to the first direction in engagement with the guide of the base body.

2. The connection module as claimed in claim 1 wherein the labeling field element has a labeling.

3. The connection module as claimed in claim 1, comprising:

a circuit board including a plurality of light sources, wherein the base body has a base section with the light out-coupling surface and at least two arm sections which adjoin the base body and each have a light in-coupling surface, each light in-coupling surface arranged to receive light from a separate light source of the circuit board.

4. The connection module as claimed in claim 3, wherein the base section and the two arm sections are configured in one piece and/or materially integrally.

5. The connection module as claimed in claim 1, wherein the base body is made from plastic.

6. The connection module as claimed in claim 1, wherein the base body has a latching element for fastening to the connection module.

7. The connection module as claimed in claim 1, wherein the connection module has an opening in which the display element is at least partially received.

8. The connection module as claimed in claim 1, wherein the connection module has a light source emitting light signals into the light in-coupling surface.

9. A display element for a connection module as claimed in claim 1.

10. A labeling field element for a display element as claimed in claim 9.

11. The connection module as claimed in claim 1, wherein the labeling field element has a labeling.

12. The connection module s claimed in claim 2, wherein the labeling field element has a guide section which is in engagement with a guide of the base body.

13. The connection module as claimed in claim 1, wherein the base body has a base section with the light out-coupling surface and at least two arm sections which adjoin the base body and each have a light in-coupling surface.

14. The connection module as claimed in claim 3, wherein the base body is made from plastic.

15. The connection module as claimed in claim 4, wherein the base body has a latching element for fastening to the connection module.

16. The connection module as claimed in claim 1, wherein the guide section is formed of a transparent material and the guide of the base body is formed of a transparent material to provide continuity in a light path from a light source to a labeling-field light out-coupling surface.

17. The connection module as claimed in claim 1 wherein the integral guide section is a protruding portion of the labeling field element and is in engagement with the guide of the base body.

* * * * *